United States Patent [19]

Wanner et al.

[11] Patent Number: 4,739,687

[45] Date of Patent: Apr. 26, 1988

[54] PUNCH

[76] Inventors: Vernon Wanner, 444 Regina La., Belvidere, Ill. 61008; Billy J. Bauscher, 7628 Elm Ave., Rockford, Ill. 61111

[21] Appl. No.: 866,659

[22] Filed: May 27, 1986

[51] Int. Cl.[4] ..... B26F 1/14

[52] U.S. Cl. ..... 83/688; 83/689

[58] Field of Search ..... 83/684–686, 83/689, 688, 698

[56] References Cited

U.S. PATENT DOCUMENTS

| | | | |
|---|---|---|---|
| 267,751 | 11/1882 | Kennedy | 83/689 |
| 891,516 | 6/1908 | Abery | 83/689 |
| 1,097,669 | 5/1914 | Philp | 83/589 |
| 2,126,519 | 8/1938 | Vogel | 83/688 |
| 2,217,560 | 10/1940 | Michon | 83/684 |
| 2,287,168 | 6/1942 | Duncan | 83/685 |
| 3,580,269 | 5/1971 | Ehrens et al. | 408/199 |

FOREIGN PATENT DOCUMENTS

| | | | |
|---|---|---|---|
| 863202 | 9/1981 | U.S.S.R. | 83/685 |

*Primary Examiner*—E. R. Kazenske
*Assistant Examiner*—Hien H. Phan
*Attorney, Agent, or Firm*—Lackenbach Siegel Marzullo & Aronson

[57] ABSTRACT

The punch includes a working end with multiple working surfaces of special configuration to reduce the force required to effect punching and improve stripping action from the workpiece.

4 Claims, 1 Drawing Sheet

PUNCH

FIELD OF THE INVENTION

The present invention relates to sheet metal punches with lower punch force required to effect hole punching and improved stripping action from the workpiece.

BACKGROUND OF THE INVENTION

Numerous punch configurations for sheet metal are known in the art; e.g. the Philip U.S. Pat. No. 1,097,669 issued May 26, 1914, the Abery U.S. Pat. No. 891,516 issued June 23, 1908; the Duncan U.S. Pat. No. 2,287,168 issued June 23, 1942 and the Ehrens et al U.S. Pat. No. 3,580,269 issued May 25, 1971, illustrate punch constructions of various types.

In many punching applications, a small diameter pilot hole is first punched in the workpiece so that a draw stud of a larger diameter punch and die set can be inserted therethrough to punch a desired larger diameter hole. There is a need to improve pilot hole punches to increase the range of thicknesses of material punchable by a given pilot hole punch by lowering the force required to force the punch through the material.

SUMMARY OF THE INVENTION

The present invention contemplates an improved punch requiring less driving force to force it through material and exhibiting enhanced stripping action from the punched material.

The punch of the invention includes a working end having a novel combination of multiple working faces to achieve the above-stated improvement and especially useful, although not limited, as a pilot hole punch.

In a typical working embodiment of the invention, first, second and third working surfaces extend successively across the working end of the punch and slope toward the punch base in the same direction at successively decreasing angles relative to the base.

DESCRIPTION OF PREFERRED EMBODIMENTS

Figure 1:
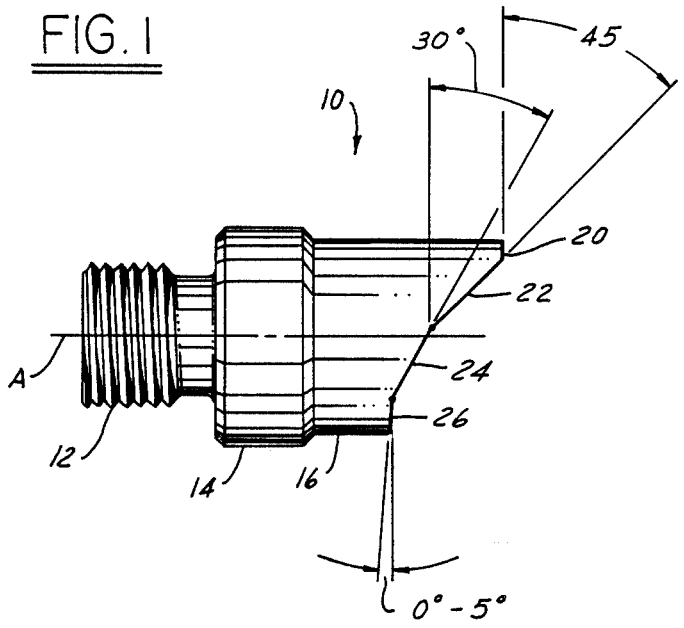
FIG. 1 is an elevation of one punch embodiment of the invention.
Figure 2:
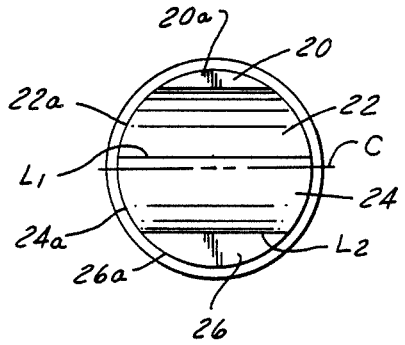
FIG. 2 is a right end view of the punch of FIG. 1.

FIGS. 1–2 illustrate a preferred embodiment of the punch of the invention for punching pilot holes in sheet metal or other materials.

The punch includes an elongate punch body 10 of metal having a threaded shank or end 12 adapted to be engaged by any suitable punch driver (not shown). Extending from the shank or end 12 is a cylindrical intermediate base 14 supporting therefrom a cylindrical working end 16 of reduced diameter. The working end 16 includes a flat 20 and working faces 22, 24 and 26 as shown and to be described herebelow.

The punch body 10 has a longitudinal central axis A with intermediate base 14 being substantially perpendicular to the axis A. A diametral center plane C containing axis A is shown in FIG. 2.

As mentioned, working end 16 includes a flat 20 and multiple flat planar working faces 22, 24 and 26 which, as shown, in FIGS. 1 and 2 extend across the working end from one side to the other. Flat 20 and each working face includes outer cutting edges **20*a*, 22*a*, 24*a* and 26*a*** collectively defining the outer circumferential cutting edge of the working end as shown.

It is apparent that flat 20 is substantially parallel with intermediate base 14, that is, perpendicular to the center plan C. Working surface 22 slopes sharply toward the base 14, working surface 24 slopes less sharply toward base 14 and working surface 26 even less sharply toward base 14. It is also apparent that working surfaces 22, 24, 26 slope in the same direction, i.e. from right to left in FIG. 1 toward the base 14. Working surface 22 may alternatively extend to the outer circumferential edge of working end 16 so as to provide a sharp piercing edge and more or less eliminate flat 20.

Preferred angles of slope for working surfaces 22, 24, 26 are generally 45°, 30° and 0–5°, respectively, relative to base 14 in FIG. 1. As is apparent, surfaces 22, 24, 26 slope at successively decreasing angles relative to the base 14.

Preferably, working surface 22 and 24 intersecting along line $L_1$ offset above the center plane C in FIG. 2 while working surfaces 24 and 26 intersect along line $L_2$ offset below the center plane C in FIG. 2.

The sharp angle (45°) of working surface 22 permits easy penetration of the workpiece material and resultant lower driving force required by a punch driver. Intersection of working surfaces 22,24 along line $L_1$ offset above the center plane C in FIG. 2 provides reduced shear at the widest diametral punch size and results in improved stripping action from the punched workpiece material. Intersection of working surfaces 24,26 along line $L_2$ below the center plane C promotes workpiece stripping action during the final stages of punching where the workpiece material tends to be pulled into the die (not shown) of conventional construction having a cylindrical passage to receive the punch working end 16.

The flat 20 and working surfaces 22, 24, 26 on the working end 16 extend the capacity of a given punch driver from 14–16 gage low carbon steel at three-fourths inch outer diameter of the punch, to 10–12 gage low carbon steel at three-eighths inch outer diameter of the punch and allow pilot holes to be punched rather than drilled.

While certain specific and preferred embodiments of the invention have been described in detail, those skilled in the art will recognize that various modifications and changes can be made therein within the scope of the appended claims which are intended to include equivalents of such other embodiments.

We claim:

1. A punch body having a base and a working end connected thereto with the working end having multiple flat planar working surfaces extending successively across the all said working surfaces sloping toward the base in the same direction at successively decreasing angles relative to the base.

2. A punch body having a base and a working end connected thereto, said working end having multiple flat planar working surfaces extending successively across the working end and sloping toward the base in the same direction at successively decreasing angles relative to the base, wherein the multiple working surfaces include first, second and third surfaces with the first and second surfaces intersecting along a first line offset from a center plane through the punch body and the second and third surfaces intersecting along another line offset on a side of the center plane opposite from said first line of intersection.

3. A punch body having a base and a working end connected thereto, said working end having multiple flat planar working surfaces extending successively across the working end and sloping toward the base in the same direction at successively decreasing angles relative to the base, said body further includes a flat substantially parallel with the base adjacent a side of the working end and from which the multiple surfaces successively extend across the working end from one side to another transverse to the longitudinal axis of the punch.

4. A punch body having a base and a working end connected thereto, said working end having multiple flat planar working surfaces extending successively across the working end and sloping toward the base in the same direction at successively decreasing angles relative to the base, wherein the multiple working surfaces include a first surface sloping at a generally 45° angle relative to the base, a second surface sloping at a generally 30° angle relative to the base and a third surface sloping at up to a generally 5° angle relative to the base.

* * * * *